United States Patent [19]

Calhoun

[11] Patent Number: 4,988,125

[45] Date of Patent: Jan. 29, 1991

[54] TARIFF RATING SYSTEM

[75] Inventor: George W. Calhoun, Clinton, Ohio

[73] Assignee: Roadway Express, Inc., Akron, Ohio

[21] Appl. No.: 937,442

[22] Filed: Dec. 4, 1986

Related U.S. Application Data

[63] Continuation of Ser. No. 558,315, Dec. 5, 1983, abandoned.

[51] Int. Cl.[5] ..... B42D 15/00

[52] U.S. Cl. ..... 283/67; 283/32

[58] Field of Search ..... 283/67

[56] References Cited

U.S. PATENT DOCUMENTS

| | | | |
|---|---|---|---|
| 1,029,085 | 6/1912 | Robinson . | |
| 1,422,245 | 7/1922 | West | 283/23 |
| 1,459,176 | 6/1923 | Bennett | 283/23 |

OTHER PUBLICATIONS

Zip Disk advertisement, Industry Week, vol. 230, No. 5, p. 23, 9/1/1986.

*Primary Examiner*—Timothy V. Eley

*Attorney, Agent, or Firm*—Renner, Kenner, Greive, Bobak, Taylor & Weber

[57] ABSTRACT

A system for establishing shipping charges, particularly for the trucking industry, interstate commerce. A matrix, based on zip code prefixes, or zip zones, is established to cover a shipping area. A first axis of the matrix is designated as source zones, while the other axis is designated as destination zones. A scale number is attributed to each pair of source and destination zones within the matrix. Each scale number has an associated base rate number, this base rate number being modified by a rate factor number dependent upon the nature of the cargo being shipped. The total shipping cost is determined by multiplying the base rate number by the rate factor number and then multiplying that product by the total weight of the cargo.

5 Claims, 3 Drawing Sheets

SCALES

| TO ZIP CODE PREFIXES | SCALES, APPLICATION FROM ZIP CODE PREFIXES AS SHOWN HEREUNDER | | | | | | | | |
|---|---|---|---|---|---|---|---|---|---|
| | 075 | 076 | 077 | 078 | 079 | 080 | 081 | 082 | 083 |
| 279 | 2251 | 2251 | 2251 | 2252 | 2251 | 2250 | 2246 | 2250 | 225 |
| 280 | 2259 | 2259 | 2258 | 2259 | 2259 | 2257 | 2254 | 2257 | 22 |
| 281 | 2259 | 2259 | 2258 | 2259 | 2259 | 2257 | 2254 | 2257 | 22 |
| 282 | 2259 | 2259 | 2258 | 2259 | 2259 | 2257 | 2254 | 2257 | 22 |
| 283 | 2256 | 2256 | 2256 | 2257 | 2256 | 2256 | 2252 | 2256 | 2 |
| 284 | 2258 | 2258 | 2257 | 2258 | 2258 | 2256 | 2253 | 2256 | 2 |
| 285 | 2253 | 2253 | 2253 | 2254 | 2253 | 2252 | 2249 | 2252 | 2 |
| 286 | 2259 | 2259 | 2259 | 2260 | 2259 | 2258 | 2255 | 2258 | 2 |
| 287 | 2264 | 2264 | 2263 | 2264 | 2264 | 2262 | 2259 | 2262 | |
| 288 | 2264 | 2264 | 2263 | 2264 | 2264 | 2262 | 2259 | 2262 | |
| 289 | 2264 | 2264 | 2263 | 2264 | 2264 | 2262 | 2259 | 2267 | |
| 290 | 2264 | 2264 | 2263 | 2264 | 2264 | 2262 | 2259 | 224 | |
| 291 | 2264 | 2264 | 2263 | 2264 | 2264 | 2262 | 2259 | 22 | |
| 292 | 2264 | 2264 | 2263 | 2264 | 2264 | 2262 | 2259 | | |
| 293 | 2263 | 2263 | 2262 | 2263 | 2263 | 2261 | 2258 | | |
| 294 | 2266 | 2266 | 2266 | 2266 | 2266 | 2264 | 2261 | | |
| 295 | 2260 | 2260 | 2260 | 2261 | 2260 | 2259 | 2256 | | |
| 296 | 2264 | 2264 | 2264 | 2264 | 2264 | 2263 | 226 | | |
| 297 | 2258 | 2258 | 2259 | 2260 | 2258 | 2258 | 2 | | |
| 298 | 2267 | 2267 | 2267 | 2268 | 2267 | 2266 | 2 | | |
| 299 | 2269 | 2269 | 2269 | 2270 | 2269 | 2268 | | | |
| 300 | 2271 | 2271 | 2271 | 2271 | 2271 | 2270 | | | |
| 301 | 2271 | 2271 | 2271 | 2271 | 2271 | 2270 | | | |
| 302 | 2271 | 2271 | 2271 | 2271 | 2271 | 227 | | | |
| 303 | 2271 | 2271 | 2271 | 2271 | 2271 | 2 | | | |
| 304 | 2272 | 2272 | 2271 | 2272 | 2272 | 2 | | | |
| 305 | 2269 | 2269 | 2269 | 2269 | 2269 | 2 | | | |
| 306 | 2269 | 2269 | 2268 | 2269 | 2269 | 2 | | | |
| 307 | 2270 | 2270 | 2270 | 2270 | 2270 | 2 | | | |
| 308 | 2268 | 2268 | 2267 | 2268 | 2268 | 2 | | | |
| 309 | 2268 | 2268 | 2267 | 2268 | 2268 | | | | |
| 310 | 2273 | 2273 | 2272 | 2273 | 2273 | | | | |
| 312 | 2273 | 2273 | 2272 | 2273 | 2273 | | | | |
| 313 | 2270 | 2270 | 2269 | 2270 | 2270 | | | | |
| 314 | 2270 | 2270 | 2269 | 2270 | 2270 | | | | |
| 315 | 2274 | 2274 | 2273 | 2274 | 2274 | | | | |
| 316 | 2276 | 2276 | 2276 | 2276 | 227 | | | | |
| 317 | 2277 | 2277 | 2276 | 2277 | 2 | | | | |
| 318 | 2276 | 2276 | 2275 | 2276 | | | | | |
| 319 | 2276 | 2276 | 2275 | 2276 | | | | | |
| 320 | 2275 | 2275 | 2275 | 2275 | | | | | |
| 322 | 2275 | 2275 | 2275 | 227 | | | | | |
| 323 | 2279 | 2279 | 2279 | 22 | | | | | |
| 324 | 2283 | 2283 | 2283 | 2 | | | | | |
| 325 | 2284 | 2284 | 2284 | 2 | | | | | |
| 326 | 2277 | 2277 | 2277 | 2 | | | | | |
| 327 | 2281 | 2281 | 2281 | | | | | | |
| 328 | 2281 | 2281 | 2281 | | | | | | |
| 329 | 2282 | 2282 | 2 | | | | | | |
| 330 | 2289 | 2289 | 2 | | | | | | |
| 331 | 2289 | 2289 | | | | | | | |
| 333 | 2289 | 2287 | | | | | | | |
| 334 | 2286 | 228 | | | | | | | |
| 338 | 2283 | 22 | | | | | | | |
| 336 | 2285 | 2 | | | | | | | |
| 337 | 2284 | 2 | | | | | | | |
| 338 | 2282 | 2 | | | | | | | |
| 339 | 2286 | | | | | | | | |
| 340 | 228 | | | | | | | | |
| 350 | 22 | | | | | | | | |

FIG. 1

TABLE OF CLASS RATES

| SCALE NO. | WEIGHTS | | | | | | | |
|---|---|---|---|---|---|---|---|---|
| | M/CHG | LSC | MSC | M1M | M2M | M5M | M10M | M15M |
| | RATES IN CENTS PER 100 POUNDS | | | | | | | |
| 2367 | 3534 | 1754 | 1637 | 1280 | 1035 | 815 | 811 | 811 |
| 2368 | 3595 | 1785 | 1664 | 1315 | 1086 | 840 | 835 | 835 |
| 2369 | 3615 | 1819 | 1689 | 1345 | 1102 | 849 | 847 | 847 |
| 2370 | 3666 | 1846 | 1726 | 1365 | 1125 | 876 | 870 | 870 |
| 2371 | 3690 | 1877 | 1747 | 1374 | 1147 | 890 | 884 | 884 |
| 2372 | 3730 | 1901 | 1777 | 1395 | 1158 | 905 | 899 | 89[illegible] |
| 2373 | 3759 | 1931 | 1801 | 1418 | 1179 | 915 | 909 | 90[illegible] |
| 2374 | 3787 | 1958 | 1827 | 1440 | 1201 | 927 | 924 | 9[illegible] |
| 2375 | 3819 | 1985 | 1851 | 1471 | 1233 | 944 | 939 | 9[illegible] |
| 2376 | 3859 | 2024 | 1880 | 1488 | 1240 | 955 | 953 | [illegible] |
| 2377 | 3894 | 2059 | 1902 | 1504 | 1258 | 978 | 973 | [illegible] |
| 2378 | 3917 | 2079 | 1941 | 1537 | 1279 | 990 | 987 | [illegible] |
| 2379 | 3984 | 2106 | 1962 | 1558 | 1304 | 1007 | 1004 | 10[illegible] |
| 2380 | 3988 | 2131 | 1985 | 1577 | 1320 | 1020 | 1014 | 10[illegible] |
| 2381 | 4025 | 2157 | 2013 | 1588 | 1343 | 1037 | 1032 | 10[illegible] |
| 2382 | 4059 | 2188 | 2039 | 1619 | 1362 | 1056 | 1051 | 1[illegible] |
| 2383 | 4098 | 2218 | 2067 | 1643 | 1382 | 1068 | 1061 | [illegible] |
| 2384 | 4130 | 2239 | 2088 | 1665 | 1410 | 1084 | 1080 | [illegible] |
| 2385 | 4152 | 2273 | 2127 | 1687 | 1421 | 1094 | 1082 | [illegible] |
| 2386 | 4193 | 2306 | 2151 | 1709 | 1440 | 1117 | 1113 | [illegible] |
| 2387 | 4227 | 2319 | 2160 | 1727 | 1456 | 1133 | 112[illegible] | [illegible] |
| 2388 | 4266 | 2371 | 2214 | 1750 | 1482 | 1150 | 11[illegible] | [illegible] |
| 2389 | 4296 | 2381 | 2222 | 1778 | 1504 | 1164 | 11[illegible] | [illegible] |
| 2390 | 4320 | 2416 | 2256 | 1798 | 1518 | 1176 | 1[illegible] | [illegible] |
| 2391 | 4347 | 2453 | 2288 | 1830 | 1542 | 1192 | [illegible] | [illegible] |
| 2392 | 4378 | 2479 | 2316 | 1850 | 1566 | 1206 | [illegible] | [illegible] |
| 2393 | 4406 | 2509 | 2341 | 1869 | 1587 | 1225 | [illegible] | [illegible] |
| 2394 | 4427 | 2534 | 2372 | 1895 | 1600 | 1233 | [illegible] | [illegible] |
| 2395 | 4451 | 2568 | 2398 | 1917 | 1621 | 1253 | [illegible] | [illegible] |
| 2396 | 4480 | 2587 | 2419 | 1934 | 1640 | 1271 | [illegible] | [illegible] |
| 2397 | 4502 | 2615 | 2444 | 1963 | 1657 | 1285 | [illegible] | [illegible] |
| 2398 | 4510 | 2646 | 2466 | 1975 | 1681 | 1297 | [illegible] | [illegible] |
| 2399 | 4536 | 2671 | 2490 | 2002 | 1704 | 1317 | [illegible] | [illegible] |
| 2400 | 4572 | 2718 | 2526 | 2033 | 1724 | 1334 | [illegible] | [illegible] |
| 2401 | 4584 | 2735 | 2550 | 2048 | 1746 | 1344 | [illegible] | [illegible] |
| 2402 | 4606 | 2757 | 2573 | 2064 | 1762 | 1[illegible] | [illegible] | [illegible] |
| 2403 | 4616 | 2793 | 2608 | 2091 | 1783 | 1[illegible] | [illegible] | [illegible] |
| 2404 | 4647 | 2824 | 2631 | 2118 | 1803 | 1[illegible] | [illegible] | [illegible] |
| 2405 | 4668 | 2844 | 2647 | 2131 | 1817 | 1[illegible] | [illegible] | [illegible] |
| 2406 | 4680 | 2889 | 2678 | 2162 | 1844 | [illegible] | [illegible] | [illegible] |
| 2407 | 4701 | 2902 | 2709 | 2182 | 1866 | [illegible] | [illegible] | [illegible] |
| 2408 | 4717 | 2982 | 2742 | 2211 | 1884 | [illegible] | [illegible] | [illegible] |
| 2409 | 4729 | 2962 | 2765 | 2225 | 189[illegible] | [illegible] | [illegible] | [illegible] |
| 2410 | 4750 | 2988 | 2781 | 2244 | 19[illegible] | [illegible] | [illegible] | [illegible] |
| 2411 | 4758 | 3023 | 2823 | 2266 | 1[illegible] | [illegible] | [illegible] | [illegible] |
| 2412 | 4771 | 3052 | 2848 | 2292 | [illegible] | [illegible] | [illegible] | [illegible] |
| 2413 | 4799 | 3073 | 2863 | 2314 | [illegible] | [illegible] | [illegible] | [illegible] |
| 2414 | 4810 | 3107 | 2899 | 234[illegible] | [illegible] | [illegible] | [illegible] | [illegible] |
| 2415 | 4834 | 3138 | 2920 | 23[illegible] | [illegible] | [illegible] | [illegible] | [illegible] |
| 2416 | 4842 | 3170 | 2960 | 2[illegible] | [illegible] | [illegible] | [illegible] | [illegible] |
| 2417 | 4860 | 3194 | 2984 | [illegible] | [illegible] | [illegible] | [illegible] | [illegible] |
| 2418 | 4882 | 3222 | 3005 | [illegible] | [illegible] | [illegible] | [illegible] | [illegible] |
| 2419 | 4906 | 3250 | 3023 | [illegible] | [illegible] | [illegible] | [illegible] | [illegible] |
| 2420 | 4914 | 3272 | 3040 | [illegible] | [illegible] | [illegible] | [illegible] | [illegible] |
| 2421 | 4927 | 3299 | 3088 | [illegible] | [illegible] | [illegible] | [illegible] | [illegible] |
| 2422 | 4956 | 3387 | 3107 | [illegible] | [illegible] | [illegible] | [illegible] | [illegible] |
| 2423 | 4966 | 3369 | 314[illegible] | [illegible] | [illegible] | [illegible] | [illegible] | [illegible] |
| 2424 | 4974 | 3394 | 3[illegible] | [illegible] | [illegible] | [illegible] | [illegible] | [illegible] |
| 2425 | 5001 | 3420 | [illegible] | [illegible] | [illegible] | [illegible] | [illegible] | [illegible] |
| 2426 | 5008 | 345[illegible] | [illegible] | [illegible] | [illegible] | [illegible] | [illegible] | [illegible] |
| 2427 | 5040 | 34[illegible] | [illegible] | [illegible] | [illegible] | [illegible] | [illegible] | [illegible] |
| 2428 | 5048 | 3[illegible] | [illegible] | [illegible] | [illegible] | [illegible] | [illegible] | [illegible] |
| 2429 | 5061 | [illegible] | [illegible] | [illegible] | [illegible] | [illegible] | [illegible] | [illegible] |
| 2430 | 508[illegible] | [illegible] | [illegible] | [illegible] | [illegible] | [illegible] | [illegible] | [illegible] |
| 2431 | 5[illegible] | [illegible] | [illegible] | [illegible] | [illegible] | [illegible] | [illegible] | [illegible] |
| 2432 | [illegible] | [illegible] | [illegible] | [illegible] | [illegible] | [illegible] | [illegible] | [illegible] |

FIG. 2

TARIFF RATING SYSTEM

This application is a continuation of Ser. No. 06/58,315, filed Dec. 5, 1983, which is now abandoned.

TECHNICAL FIELD

The invention herein relates to a system and technique for establishing freight rates, applicable to all common carriers, but particularly the trucking industry. The invention significantly reduces the complexity of the previously known tariff system adopted and used by the trucking industry in interstate commerce.

BACKGROUND ART

The prior art of determining a shipping charge, rate, or tariff followed a complex pattern, requiring recourse to a large volume of schedule books. The complexity of the system required an excessive number of rate clerks, each performing the following basic tasks to determine the shipping rate for a particular cargo:

1. The commodity would first be classified with recourse to the National Motor Freight Classification book (NMFC).
2. A determination would then be made as to the governing rate bureau as, for example, ECMCA, C&S, SMCRC, MW, RM, CSA, or NEMRB.
3. The basing point for the origin would be determined.
4. The basing point for the destination of the shipment would be determined.
5. The proper class rate tariff would be looked up.
6. The base rate number would be looked up.
7. The rate would then be determined by matching the base rate number and the class.

As can be seen, following the prior art technique of establishing shipping charges or tariffs, recourse was taken to a number of different data sources, generally found in different books, catalogs, or tables.

The complexity of the prior art system for determining shipping charges was a result of the establishment of various rate bureaus by the Interstate Commerce Commission (ICC). With upwards of a dozen rate bureaus, each having its own shipping rate publications, and with certain bureaus dominating others, the complexity of rate charge determination can be readily appreciated.

Inherent in the prior art is the great room for error in making rate calculations. The multiplicity of operations and data sources results in increased possibilities for error in determining the shipping charge. Indeed, businesses have been formed for the sole purpose of reviewing shipping tariffs and recovering for erroneous charges. Yet further, the prior art technique for determining such charges is time-consuming, expensive, and difficult to learn.

SUMMARY OF THE INVENTION

In light of the foregoing, as a first aspect of the invention there is provided a tariff rating system which is simplistic in nature, greatly reducing the room for error of the prior art system.

Yet another aspect of the invention is a tariff rating system in which the entire continental United States is covered in a single book, without the necessity of recourse to the books of a plurality of tariff bureaus, and wherein every conceivable source and destination of goods shipped in interstate commerce is covered.

Still an additional aspect of the invention is a tariff rating system which, in contradistinction to the prior art, is easy to learn and comprehend.

Yet another aspect of the invention is the provision of a tariff rating system which may be used in a time-efficient manner.

The foregoing and other aspects of the invention which will become apparent as the detailed description proceeds are achieved by a method for determining charges for shipping cargo interstate, comprising the steps of: generating a matrix of source and destination zones; attributing a scale number to each pair of source and destination zones within said matrix; attributing a base rate number to each scale number; establishing a rate factor number according to the nature of the cargo; and determining an actual rate for shipping the cargo by multiplying said base rate by said rate factor number.

DESCRIPTION OF DRAWINGS

For a complete understanding of the objects, technique, and structure of the invention, reference should be had to the following detailed description and accompanying drawings wherein:

FIG. 1 is a plan view of the source and destination matrix of the invention;

FIG. 2 is a plan view of the scale number matrix of the invention, showing the shipping rate per pound for various scale numbers taken from the matrix of FIG. 1.

BEST MODE FOR CARRYING OUT THE INVENTION

Figure 3:
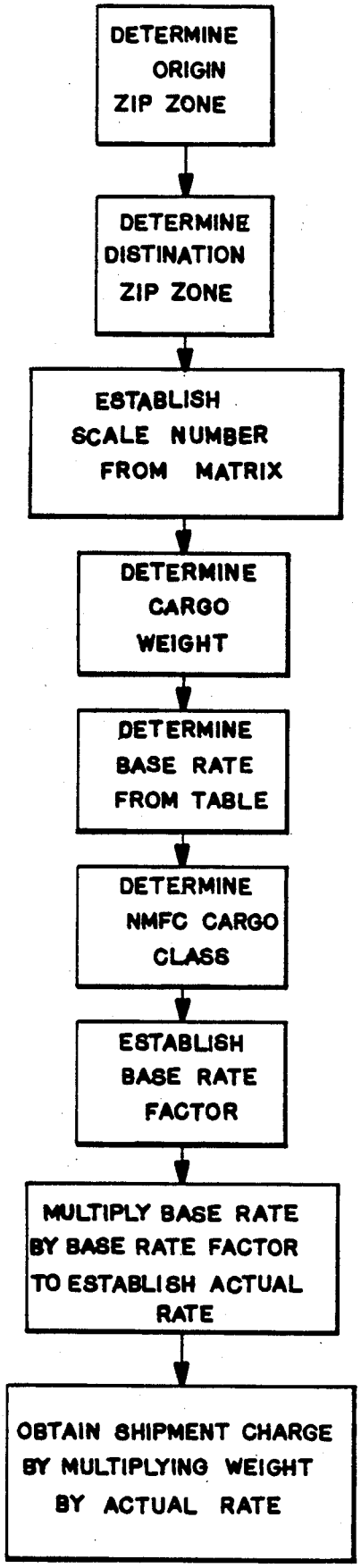
FIG. 3 is a flow chart depicting the method of the invention.

The present invention is based upon the concept of parcelling the continental United States, or any other suitable geographic region, into a plurality of zones. Each zone is given a unique numerical designation for purposes of identification. The average shipping rate between pairs of zones, for all such pairs, is then determined. These shipping rates are determined under the existing tariff bureau system, based on mileage between the two zones as weighted by the shipping rate established by the controlling tariff bureau between those zones. These shipping rates are accorded scale numbers, which scale numbers may be purely arbitrary so long as each pair of zones having the same shipping rate therebetween has the same scale number associated therewith. In any event, a scale number associated with two geographical zones is an indication of the range of mileage between those two zones as weighted by the controlling tariff bureau's shipping rate.

Each scale number then has associated with it a base rate of charge per given weight of a standard cargo shipped the distance associated with the scale number. In other words, the base rate associated with a given scale number would be the rate, in cost per pound, to ship a standard cargo the distance associated with the scale number.

Since the base rate is determined on the basis of a standard cargo, adjustments of the rate most be made depending on the nature of the cargo. As is well known, commodities are divided into classification set by the National Motor Freight Classification book as to bulk, ease of handling, and the like. Each commodity has an NMFC number. Associated with the NMFC number is a factor which may be used to modify the base rate for the standard cargo. In other words, the base rate may then be modified, either by increase or decrease, dependent upon the nature of the cargo being shipped, such nature being established by the NMFC number. By multiplying the base rate by the factor established from the NMFC number, the actual shipping rate for the cargo can be established.

Finally, by multiplying the actual shipping rate by the actual weight of cargo being shipped, the total shipping charge may be determined.

The concept of the invention is readily implemented utilizing the zip code prefixes as devised by the United States Postal Service. These prefixes typically comprise the three most significant digits of a zip code and define rather distinct geographical locations. Since the entire continental United States is parcelled into postal zones designated by zip codes, utilization of zip code prefixes readily provides a means for identifying every geographical locally in the country.

Having divided the country into uniquely designated zones by utilizing zip code prefixes, a matrix covering the entire country may be developed as shown in FIG. 1. It will be understood that the matrix of FIG. 1 is only a partial illustration of the entire matrix that would be generated to cover the entire continental United States. In its total form, the horizontal scale provided at the top of the matrix would sequentially extend from zip code prefix 010 through 994. These prefixes would be used to designate the origin of cargo to be shipped. In similar fashion, a sequential listing of zip code prefixes would be used to identify the vertical axis of the matrix as shown. The vertical axis designates the destination zones for the cargo.

The matrix is completed by associating with each pair of zip code prefixes, one on the horizontal (origin) axis and the other on the vertical (destination) axis, a scale number. As mentioned above, the scale numbers are established by taking into account the shipping distance or mileage between the two zip code prefixes or zip zones, as weighted by the shipping rates set by the tariff bureau controlling the transportation of cargo between the two zones. Accordingly, pairs of zones which would have similar costs for shipment of cargo therebetween under the tariff bureau system would be accorded the same scale number in the matrix of FIG. 1. Apart from this requirement, the actual generation of the scale number is arbitrary. In any event, the result is a matrix having a horizontal axis sequentially listing all of the zip zones of the continental United States as cargo origin zones, a vertical axis listing all of the zip zones of the United States as cargo destination zones, and a scale number associated with each pair of origin and destination zones, such scale number being a function of the mileage between the two zones as weighted by the shipping rate of the tariff bureau controlling shipments between such zones.

Having established a scale number for each zip zone pair, it is now necessary to correlate the various scale numbers with actual shipping rates. To this end, a table of class rates is devised as shown, in part, in FIG. 2. Again, it will be understood that only a portion of the table of class rates is shown in FIG. 2, and that the actual table would include all scale numbers which have been devised. As shown, the table of class rates, correlated to scale numbers, provides for a breakdown of shipping rates (base rate numbers), listing a minimum charge (M/CHG), and then for weights in the categories of less than five hundred pounds (L 5C), more than five hundred pounds (M 5C), more than one thousand pounds (M 1M), more than two thousand pounds (M 2M), more than five thousand pounds (M 5M), more than ten thousand pounds (M10M), and more than fifteen thousand pounds (M15M). The base rates are given in cents per one hundred pounds, except, of course, for the minimum charge which is in cents only.

It will be understood that the table of FIG. 2 lists shipping rates or base rate numbers for a standard type of cargo. These rates are altered depending upon the classification of the cargo as determined from the National Motor Freight Classification book from which the NMFC classification factor may be obtained. It is understood by those skilled in the art that such a classification is used to modify shipping rates from a standard rate, the modification being dependent upon the bulk, physical size, and other freight criteria. The matrix of FIG. 1, rather than being on a single sheet of inordinate size, may be reduced to a plurality of pages such as may be bound in book form. In similar fashion, the table of class rates as shown in FIG. 2 may be included in the same book. The National Motor Freight Classification book, containing the factors for modifying shipping rates, is already existent. Accordingly, having in hand a single book containing the matrix of FIG. 1 and the table of rates of FIG. 2, and the existent National Motor Freight Classification book, the charge for shipping any cargo in the United States can be readily ascertained. Of course, based on this same concept, shipping in other countries or between countries can be similarly facilitated. It should be understood that the matrix of FIG. 1-would typically include blank spaces for those shipments which would be intrastate only. Since the concept of tariff bureaus and the regulation of the ICC extends only to interstate commerce, no scale numbers would be provided for pairs of zip zones which would constitute intrastate shipping only. However, the concept of the invention can be readily expanded to intrastate shipping.

With reference now to FIG. 3, the method for utilizing the concepts just presented may be seen in the form of a flow chart. When a shipping order is received, the origin zip zone is readily determined since the bill of lading would typically include the zip code of both the sender and the receiver. In like fashion, the destination zip zone is readily ascertained. Of course, should the bill of lading not include the zip codes, the tariff clerk need merely take recourse to the United States Post Office Zip Code Directory to determine the origin and destination zip zones. Recourse is then had to the matrix of FIG. 1. The clerk locates the scale number at the intersection on the matrix between the origin zip zone and the destination zip zone. Next, the clerk determines the cargo weight, typically by reference to the bill of lading or by other appropriate means. Knowing the cargo weight, the base rate number for shipping such cargo may be determined from the table of class rates as shown in FIG. 2 by selecting the appropriate weight associated with the scale number determined above. The base rate for shipping the cargo has then been determined. Next, the clerk determines the NMFC classification for the cargo. Knowing this, a base rate factor can be readily established by reference to the National Motor Freight Classification book. The actual rate for shipping the cargo is then determined by multiplying the base rate number by the base rate factor appropriately increasing or decreasing the rate dependent upon the nature of the cargo. Finally, the total shipping charge is obtained by simply multiplying the cargo weight by the actual rate.

It can be seen that the concept of the instant invention greatly reduces the time and effort necessary to obtain shipping charges. Recourse need only be made to the matrix of FIG. 1, the table of rates of FIG. 2, and the National Motor Freight Classification book. The time-consuming, complex, and error-ridden procedure of the past has thus been greatly simplified.

Thus it can be seen that the objects of the invention have been satisfied by the structure and technique presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be had to the appended claims.

I claim:

1. A method for determining charges for shipping cargo interstate, comprising the steps of:

generating a chart containing a matrix of source and destination zones, said matrix pairing said source and destination zones;

attributing a scale number to each pair of source and destination zones within said matrix, said scale numbers being derived from an average of shipment distances between the associated pair of source and destination zones;

attributing a base rate number to each scale number;

establishing a rate factor number according to the nature of the cargo; and determining an actual rate for shipping the cargo from one of said source zones to one of said destination zones by multiplying an associated base rate number by said rate factor number.

2. The method as recited in claim 1 wherein said source and destination zones are derived from numbers accorded postal mailing zones.

3. The method as recited in claim 2 wherein said source and destination zones are derived from the three most significant digits of the numbers accorded said postal mailing zones.

4. The method as recited in claim 3 which further includes the steps of multiplying said actual rate by the total weight of the cargo.

5. The method as recited in claim 1 wherein said rate factor number is a National Motor Freight Classification number.

* * * * *